US006089394A

United States Patent [19]

Ziglar

[11] Patent Number: 6,089,394

[45] Date of Patent: Jul. 18, 2000

[54] COLLAPSIBLE HAMPER FOR THE STORAGE OF LAUNDRY AND OTHER ITEMS

[75] Inventor: Paul S. Ziglar, Burlington, Iowa

[73] Assignee: Lamont Limited, Burlington, Iowa

[21] Appl. No.: 08/681,124

[22] Filed: Jul. 22, 1996

[51] Int. Cl.[7] ..... B65D 33/00

[52] U.S. Cl. ..... 220/6; 220/9.2; 220/9.3; 220/838

[58] Field of Search ..... 220/6, 9.2, 9.3, 220/837, 838

[56] References Cited

U.S. PATENT DOCUMENTS

| | | |
|---|---|---|
| Re. 33,842 | 3/1992 | Ebentheuer . |
| D. 213,131 | 1/1969 | Hamilton . |
| D. 215,846 | 11/1969 | Curtin et al. . |
| 216,227 | 6/1879 | Sedgwick . |
| 218,227 | 8/1879 | Brown, Jr. . |
| D. 274,662 | 7/1984 | Fausel . |
| D. 279,038 | 5/1985 | Thompson, Jr. . |
| D. 279,249 | 6/1985 | Fausel . |
| D. 288,019 | 1/1987 | Gebhard et al. . |
| D. 290,538 | 6/1987 | Basore . |
| D. 293,383 | 12/1987 | Thompson . |
| D. 342,365 | 12/1993 | Conaway . |
| D. 344,823 | 3/1994 | Wilgus . |
| D. 362,931 | 10/1995 | Brightbill . |
| D. 362,933 | 10/1995 | Calmeise . |
| D. 366,120 | 1/1996 | Atkinson . |
| 481,957 | 9/1892 | Klank . |
| 945,918 | 1/1910 | Crawford . |
| 1,144,643 | 6/1915 | Elkins . |
| 1,181,829 | 5/1916 | Bower . |
| 1,263,294 | 4/1918 | Taylor . |
| 1,394,007 | 10/1921 | Hall . |
| 1,454,388 | 5/1923 | Lauren . |
| 1,520,532 | 12/1924 | Clark . |
| 1,640,083 | 8/1927 | Ladd . |
| 1,647,679 | 11/1927 | Williams . |
| 1,703,066 | 2/1929 | Horn . |

(List continued on next page.)

FOREIGN PATENT DOCUMENTS

| | | |
|---|---|---|
| 1382530 | 11/1964 | France . |
| 5939 | of 1915 | United Kingdom . |
| 140570 | 4/1920 | United Kingdom . |
| 2 126 535 | 3/1984 | United Kingdom . |
| 2 212 114 | 3/1989 | United Kingdom . |

OTHER PUBLICATIONS

Patent Application re: prior art product sold in U.S. by Stephen A. Fausel and Paul S. Zigler: specification for Collapsible Furniture.

Eileen Douglas Letter of May 25, 1993.

Eileen Douglas Letter of Aug. 26, 1996.

*Primary Examiner*—Joseph M. Moy

*Attorney, Agent, or Firm*—Simmons, Perrine, Albright & Ellwood, P.L.C.

[57] ABSTRACT

A collapsible hamper having top and bottom generally stiff frames, a body of flexible sheet material secured to and extending lengthwise between the frames, and a plurality of generally stiff legs each having top and bottom ends, the hamper having collapsed and assembled states, each leg positionable transversely between and engaging the top and bottom frames with its top and bottom ends respectively for urging the frames apart and thereby stretching the body in the lengthwise direction when the hamper is in its assembled state, the frames being moved towards each other and the body folded when the hamper is in the collapsed state has stretchable elastic hinge means fixedly attaching the top end of each leg to said top frame. Each of the legs is movable between a first position with the leg extending transversely from the top frame and the leg's bottom end releasably engaging the bottom frame when the hamper is in it assembled state, to a second position with the leg pivoted to be generally parallel and closely adjacent the top frame and the leg's bottom end separated from the bottom frame when the hamper is in its collapsed state. The hinge means, when the leg is pivoted, is stretched and urges the leg to return to the first position.

21 Claims, 7 Drawing Sheets

U.S. PATENT DOCUMENTS

| | | | |
|---|---|---|---|
| 1,836,297 | 12/1931 | Vienna . | |
| 2,009,035 | 7/1935 | Towers . | |
| 2,042,888 | 6/1936 | Flood . | |
| 2,071,850 | 2/1937 | Miller . | |
| 2,115,308 | 4/1938 | Koch . | |
| 2,295,584 | 9/1942 | Larson . | |
| 2,361,743 | 10/1944 | Butler . | |
| 2,544,074 | 3/1951 | Ernst et al. . | |
| 2,600,501 | 6/1952 | Higgs . | |
| 2,625,973 | 1/1953 | Weldon . | |
| 2,639,819 | 5/1953 | Marks . | |
| 2,664,131 | 12/1953 | Miller . | |
| 2,721,099 | 10/1955 | Rupp . | |
| 2,767,757 | 10/1956 | Marder . | |
| 2,780,402 | 2/1957 | Zucker et al. . | |
| 2,837,860 | 6/1958 | Norling . | |
| 2,958,357 | 11/1960 | Vorgan . | |
| 3,014,516 | 12/1961 | Mueller . | |
| 3,017,117 | 1/1962 | Klingler . | |
| 3,061,396 | 10/1962 | Hock . | |
| 3,126,933 | 3/1964 | Mason et al. . | |
| 3,160,307 | 12/1964 | Morrison . | |
| 3,257,077 | 6/1966 | Corning . | |
| 3,265,284 | 8/1966 | Tomkins . | |
| 3,310,089 | 3/1967 | Silverman . | |
| 3,354,924 | 11/1967 | Birrell et al. . | |
| 3,381,844 | 5/1968 | Sieve | 220/837 |
| 3,410,328 | 11/1968 | Sasai . | |
| 3,439,865 | 4/1969 | Port et al. . | |
| 3,480,059 | 11/1969 | Schoening . | |
| 3,583,748 | 6/1971 | Arndt . | |
| 3,603,367 | 9/1971 | Lehrman . | |
| 3,618,161 | 11/1971 | Nozawa | 220/838 |
| 3,661,326 | 5/1972 | Wilson . | |
| 3,675,981 | 7/1972 | Mallander . | |
| 3,727,786 | 4/1973 | Fausel . | |
| 3,732,978 | 5/1973 | Reader . | |
| 3,737,066 | 6/1973 | Ames | 220/837 |
| 3,796,342 | 3/1974 | Sanders et al. . | |
| 3,799,384 | 3/1974 | Hurkamp . | |
| 3,843,222 | 10/1974 | Berkun . | |
| 3,868,155 | 2/1975 | Cherubini . | |
| 3,893,649 | 7/1975 | Cornell . | |
| 3,946,903 | 3/1976 | Parker . | |
| 3,955,706 | 5/1976 | Whitaker . | |
| 3,961,721 | 6/1976 | Gordon et al. | 220/837 |
| 4,094,639 | 6/1978 | McMillan . | |
| 4,118,089 | 10/1978 | Johnson et al. . | |
| 4,134,225 | 1/1979 | Welch . | |
| 4,180,113 | 12/1979 | Liebling . | |
| 4,195,804 | 4/1980 | Hujsak . | |
| 4,246,945 | 1/1981 | Sterling . | |
| 4,248,442 | 2/1981 | Barrett . | |
| 4,287,701 | 9/1981 | Washington . | |
| 4,299,365 | 11/1981 | Battle . | |
| 4,313,634 | 2/1982 | Williams . | |
| 4,352,457 | 10/1982 | Weick . | |
| 4,401,213 | 8/1983 | Lemer . | |
| 4,411,300 | 10/1983 | Rico . | |
| 4,427,110 | 1/1984 | Shaw, Jr. . | |
| 4,580,776 | 4/1986 | Burkinshaw . | |
| 4,585,283 | 4/1986 | Redmon et al. . | |
| 4,610,394 | 9/1986 | Bryson . | |
| 4,630,747 | 12/1986 | Chiang et al. . | |
| 4,646,802 | 3/1987 | Basore et al. . | |
| 4,683,927 | 8/1987 | Pyzer . | |
| 4,706,845 | 11/1987 | Schnurer . | |
| 4,715,572 | 12/1987 | Robbins, III . | |
| 4,728,066 | 3/1988 | Lang et al. . | |
| 4,730,748 | 3/1988 | Bane . | |
| 4,738,478 | 4/1988 | Bean, Jr. . | |
| 4,747,701 | 5/1988 | Perkins . | |
| 4,759,518 | 7/1988 | Yardas . | |
| 4,779,794 | 10/1988 | Moore . | |
| 4,781,300 | 11/1988 | Long . | |
| 4,783,031 | 11/1988 | Ebentheuer . | |
| 4,854,501 | 8/1989 | Ricci . | |
| 4,858,634 | 8/1989 | McLeese . | |
| 4,896,787 | 1/1990 | Delamour et al. | 220/838 |
| 4,899,967 | 2/1990 | Johnson . | |
| 4,903,584 | 2/1990 | Styles . | |
| 4,925,102 | 5/1990 | Jones . | |
| 4,940,200 | 7/1990 | Sawyer et al. . | |
| 4,946,118 | 8/1990 | Hastings . | |
| 4,948,077 | 8/1990 | Gonzalez . | |
| 4,953,735 | 9/1990 | Tisbo et al. | 220/837 |
| 4,964,859 | 10/1990 | Feldman . | |
| 4,989,749 | 2/1991 | Choi . | |
| 5,022,767 | 6/1991 | Cardulla . | |
| 5,027,748 | 7/1991 | Wolak . | |
| 5,031,793 | 7/1991 | Chen . | |
| 5,036,999 | 8/1991 | Bitsch . | |
| 5,038,812 | 8/1991 | Norman . | |
| 5,082,219 | 1/1992 | Blair . | |
| 5,137,044 | 8/1992 | Brady . | |
| 5,143,283 | 9/1992 | Lancaster . | |
| 5,174,462 | 12/1992 | Hames . | |
| 5,195,649 | 3/1993 | Wolters . | |
| 5,253,775 | 10/1993 | Gould . | |
| 5,263,672 | 11/1993 | He . | |
| 5,273,142 | 12/1993 | Weber . | |
| 5,283,611 | 2/1994 | Kobayashi . | |
| 5,301,705 | 4/1994 | Zheng . | |
| 5,324,490 | 6/1994 | Van Vlahakis . | |
| 5,335,805 | 8/1994 | Chen . | |
| 5,337,772 | 8/1994 | Habchi . | |
| 5,356,024 | 10/1994 | Ho . | |
| 5,358,440 | 10/1994 | Zheng . | |
| 5,360,028 | 11/1994 | Jasin . | |
| 5,375,267 | 12/1994 | Davis . | |
| 5,382,087 | 1/1995 | Pouch . | |
| 5,393,023 | 2/1995 | Callan . | |
| 5,411,046 | 5/1995 | Wan . | |
| 5,429,437 | 7/1995 | Shaw et al. . | |
| 5,437,384 | 8/1995 | Farrell . | |
| 5,437,410 | 8/1995 | Babasade . | |
| 5,439,017 | 8/1995 | Wood . | |
| 5,439,018 | 8/1995 | Tsai . | |
| 5,449,083 | 9/1995 | Dougherty . | |
| 5,464,113 | 11/1995 | Ho . | |
| 5,467,794 | 11/1995 | Zheng . | |
| 5,468,061 | 11/1995 | Fries . | |
| 5,474,196 | 12/1995 | Fausel . | |
| 5,492,675 | 2/1996 | Brizard . | |
| 5,593,046 | 1/1997 | Katsuura et al. . | |

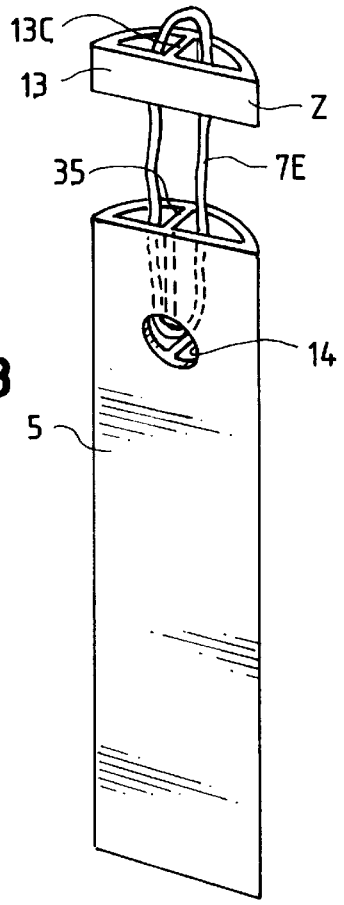
FIG. 13
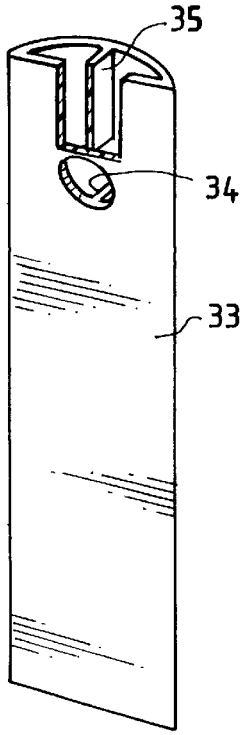
FIG. 14
FIG. 16
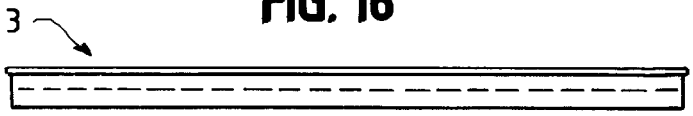
FIG. 15
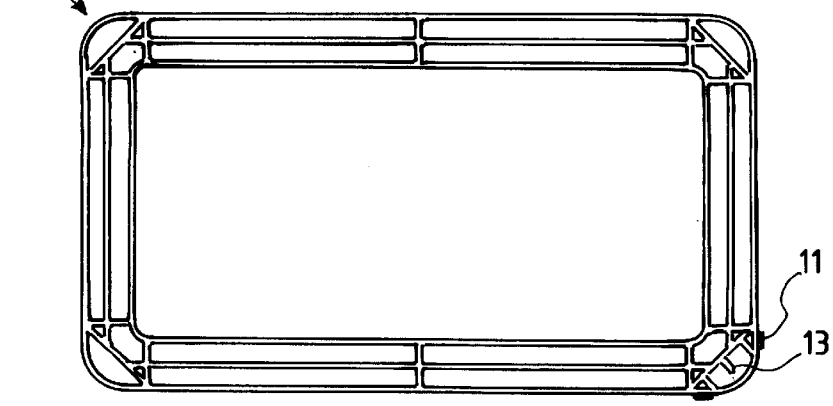

COLLAPSIBLE HAMPER FOR THE STORAGE OF LAUNDRY AND OTHER ITEMS

BACKGROUND OF INVENTION

A. Technical Field of the Invention

This invention is in the field of hampers used for containing and transporting laundry, and particularly hampers that have an upright, assembled state and are collapsible into a collapsed state forming a relatively thin package for storage, display and transport.

B. Description of Related Prior Art

The prior art includes various collapsible laundry baskets and containers for use in the storage and transportation of laundry. These designs, however, all include one or more undesirable features. Some are bulky and inconvenient for display and sale; some are expensive to manufacture; some are difficult for the user to assemble. For example, U.S. Pat. Nos. 5,464,113 and 5,356,024 disclose a hamper composed of a flexible material stretched between two rigid frames by means of four, independent fully-removable legs or braces. This hamper requires the user to position and orient the legs, which is awkward while exerting great force to stretch the sheet material of the hamper by wedging the independent free ends of the legs between the hamper's rigid frames. U.S. Pat. No. 3,727,786 discloses a hamper formed of a body containing an elongated portion divided into four framed sections with hinges to allow folding and unfolding of the hamper. The hamper collapses into a package of considerable thickness due to the requirement of placing hinges at the edges of the framed sections, and requires additional manufacturing costs for the hinge mechanisms in the hamper body. U.S. Pat. No. 5,474,196 discloses a ready-to-assemble hamper including a bottom frame, a top frame, and a body panel joining the top and bottom frames fitting into recesses disposed upon the frames. This design discloses a hamper made of insufficiently flexible material to allow the most convenient packaging, and requires users to assemble the hamper with great care in order properly to position the hamper's components. U.S. Pat. No. 4,646,802 discloses a hamper composed of a bag removably-mounted to a supporting base defined by a pair of opposing scissor-linkages. This hamper presents the user with a design permitting the body of the hamper greatly to bulge and inadvertently to slip off of the supporting frame, while collapsing into a package only as small as the height of the supporting base itself. A still further prior art collapsible hamper has legs coupled to a frame by traditional hinges which limit movement of each leg to pivoting about a fixed axis lying parallel to the plane of the frame.

SUMMARY OF THE INVENTION

A. Objects of the Invention

It is an object of the present invention to provide a hamper for storing laundry and other items.

It is another object of the present invention to provide a hamper which can be collapsed into a relatively thin package for storage, transport and display.

It is a further object of the present invention to provide a collapsible hamper which can be assembled by users with little difficulty.

A still further object is to provide a collapsible hamper which can be manufactured with minimal cost.

Another object is to provide a collapsible hamper with legs that remain attached to the top frame while the hamper is in a collapsed state and that automatically move toward proper position and orientation during assembly.

Another object is to provide a collapsible hamper having top and bottom frames with legs which during assembly automatically move toward a vertical orientation where they support and maintain the top frame elevated above the bottom frame before full assembly is achieved.

An additional object is to provide a collapsible hamper with top and bottom frames, legs that automatically seek their proper position during assembly and with a sheet material body extending between the frames, where the sheet material cooperates with the bottom frame to releasably capture and hold the bottom ends of the legs while the hamper is assembled.

A further object is to provide a collapsible hamper having thickness when collapsed no greater than the sum of thickness of the top and bottom frames and of two legs.

B. Summary of the Invention

The new collapsible hamper is reversibly convertible between a collapsed state and an extended, assembled state. The hamper includes a top frame, a bottom frame, a body made of flexible sheet material attached to and extending between the top and bottom frames, and leg assemblies each having one end permanently coupled to the top frame and the other end releasably engagable to the bottom frame. Optionally, the leg assemblies may be permanently secured to the bottom frame with the top ends of the legs releasably engagable to the top frame. The end of each leg assembly that is permanently coupled to the top or bottom frame is movable from the frame to which it is coupled toward the other frame and is resiliently urged back toward the frame to which it is coupled whenever it is displaced therefrom. In a preferred embodiment elastic coupling means is fixed for example, to the top frame and to the top end of each leg. This elastic coupling resiliently urges the top end of the leg, when displaced, to return toward and to return into engagement with the top frame. This is particularly beneficial during assembly as explained below. The elastic coupling may be as simple as a closed loop or a straight segment of elastic cord or strap of selected cross-section.

Before assembly the top and bottom frames are positioned relatively close together in parallel with the legs folded into additional parallel planes between these frames. During assembly the top frame is separated from the bottom frame, typically being elevated above it, during which time the legs will be unfolded. As the top frame is elevated the elastic coupling automatically pulls the top of each leg toward the top frame and toward proper transverse alignment thereto and into engagement therewith. With this arrangement the user is not required to try to find, orient and engage the legs to the top frame because this occurs automatically. Also, as the legs move from a pivoted position to a transverse position and toward a final perpendicular position relative to the top and bottom frames, the bottom ends of the legs automatically engage the bottom frames, thus maintaining these frames apart with the top frame thus supported in its elevated position. This eliminates or at least significantly reduces the tendency of the hamper to keep collapsing during assembly. Without this feature assembly may be quite difficult because the final stage of assembly requires very substantial force to be applied to stretch the body sheet material in the lengthwise direction while the legs are being urged to pivot into an orientation perpendicular to the frames. The permanent coupling of one end of each of the legs to one of the frames allows the user to concentrate on positioning only the other ends of the legs, with no risk that the leg can "pop out" of position, requiring the user to then find, reposition the leg and begin the assembly process anew.

Two different elastic couplings of the leg assembles are disclosed herein with additional variations possible within the scope of this invention. The first elastic coupling is part of a three piece leg assembly comprising a long leg, a very short leg aligned with the long leg and elastic means coupling these legs together, allowing the long leg to move axially from and/or pivot relative to the short leg and to be resiliently urged to return to a position aligned and closely adjacent the short leg whenever displaced and/or pivoted therefrom. The short leg is fixed to the top frame, either at the bottom surface of the top frame or in a recess upward of the bottom surface or extending outward of this surface. This arrangement permits the leg assembly including the elastic coupling element to be fabricated independently of the remainder of the hamper, and the short leg to be later affixed to the top frame, or to the bottom frame if that version of assembly is elected.

The second variation of leg assembly is a two piece construction. Here the elastic coupling element has one part fixed to the top frame and another part fixed to the top of a long leg. This top end when urged by the elastic toward the top frame may, for example, abut the frame or may be inserted upward into a recess in the frame.

For the engagement of the bottom end of each leg to the bottom frame, two variations are disclosed herein as examples of possibilities within the scope of this invention. The bottom frame, if made from a solid board such as particle board, has a notch, step or recess cut to receive the bottom end of the leg. As the leg is pivoted toward its vertical position relative to the top and bottom frames in horizontal orientation, the sheet material body part is strongly stretched causing axial compression in each leg. When the bottom end of the leg arrives at the recess, it "pops" or snaps into place, because the compression on the leg is relieved by the added axial space available by the depth of the recess.

Once in the recess the bottom end of the leg is captured to remain in this position until forceful disassembly is begun. One construction to achieve this capture is the combination of a shoulder or wall of the recess on one side of the leg and an outer wall formed by the sheet material at the outer side of the leg. This sheet material is closely adjacent the recess because it is secured to the outer periphery of the bottom frame, and the recess is also close to or adjacent the outer periphery. Thus, the bottom end of the leg is sandwiched between the recess wall and the sheet material.

Capture of the bottom end of the leg is possible independently of the sheet material by forming the bottom frame of molded plastic with the recess included as a depression in the top surface of the bottom frame, where the recess defines walls fully surrounding the sides of the leg. The exact shape of the recess will vary with the cross-section of the bottom end of the leg and the percent of the leg's side surface that is to be encompassed.

While this invention may take many forms, the examples disclosed herein include any combination of coupling the legs to the top or bottom frame, using two-piece or three piece leg assemblies, and capturing the releasable end of the legs by the engaging frame alone or with cooperation of the adjacent sheet material.

The new hamper is highly stable in its assembled state as the sheet material body part is stretched in the lengthwise direction of the hamper between the spaced apart frames by the legs forced into compression along their lengthwise axes, and as the top and bottom ends of the legs are coupled to the top and bottom frames respectively.

The hamper of the present invention collapses into a relatively thin package because the leg coupling which pulls the legs into proper position and orientation during assembly also allows the legs to move to a position in disassembly where they lie flat between the top and bottom frames and occupy no more space than their own thickness. The total package thickness may be no more than the sum of the top frame thickness, bottom frame thickness, and twice a leg thickness where two legs lie in a first plane between the frames and two other legs lie in a second plane adjacent the first plane, plus the thickness of a traditional lid.

This invention will be better understood from the following detailed description taken in conjunction with the accompanying figures of the drawings none of which are to scale:

BRIEF DESCRIPTION OF THE DRAWINGS

FIG. 13 is an exploded perspective view not to scale of a three-piece leg assembly a long leg, short leg and an elastic strap in stretched state;

FIG. 14 is a fragmentary cut-away detail of the top end of the long leg of FIG. 13;

FIG. 15 is bottom plan view of a top frame; and

FIG. 16 is a front elevation of the top frame of FIG. 15.

DETAILED DESCRIPTION OF THE PREFERRED EMBODIMENTS

A. Overview

Figure 4:
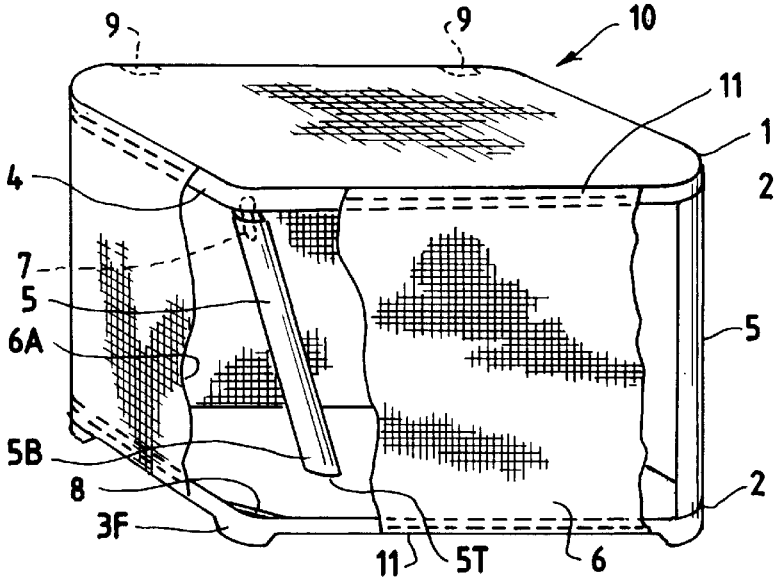
FIG. 4 is a front perspective view of hamper not to scale, partially cut-away exposing the interior of the hamper and a partially pivoted leg assembly.

FIG. 1 shows schematically the elements of the new collapsible hamper 10 and the sequence of stages of assembly in parts A–E of this figure. The basic components or elements of this hamper are best seen in FIGS. 1 and 4, namely bottom frame 3, top frame 4, sheet material body 6 defining an enclosure, legs 5, elastic hinge means 7 for each leg and lid 1. The hamper 10 is shown fully collapsed in FIGS. 1A and 2 and fully assembled in FIG. 1E.

Figure 1A:
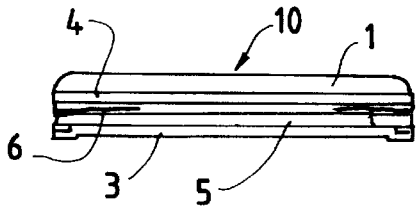
FIG. 1 is a schematic view showing a sequence of transition stages A–E of the collapsible hamper from fully collapsed to fully estimated and fully assembled.
Figure 1B:
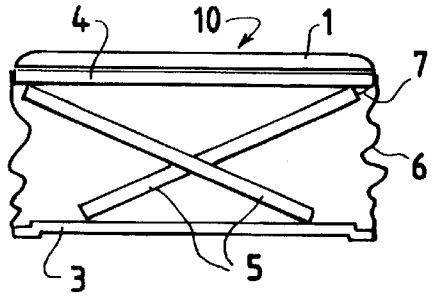
Figure 1C:
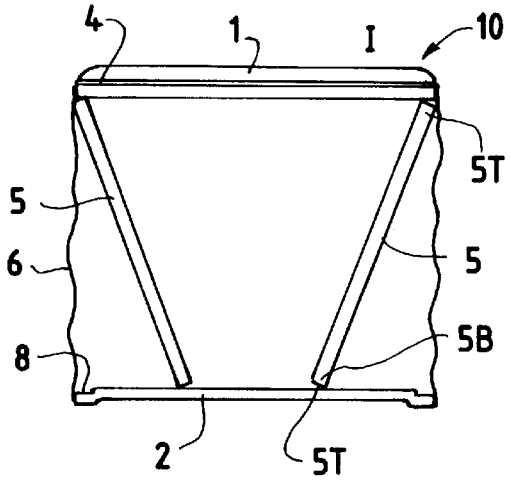
Figure 1D:
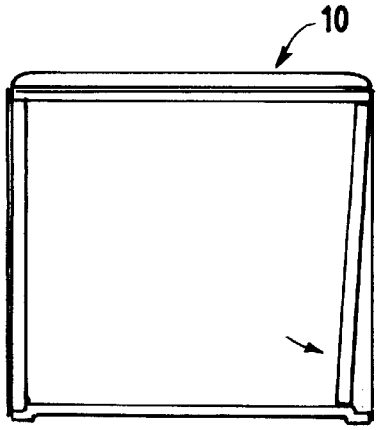
Figure 1E:
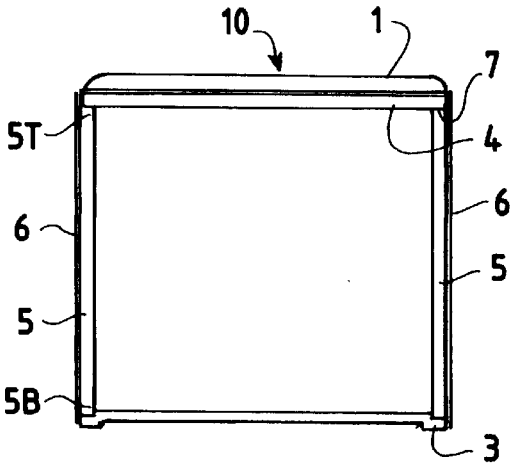

The sequence of stages of assembly is seen as: FIG. 1A—fully collapsed; FIG. 1B—top frame 4 begins separation from bottom frame 3 and legs 5 begin to unfold; FIG. 1C—all legs approach their final positions; FIG. 1D—one leg at a time is forced to its final position with its bottom end engaging a recess in the bottom frame; and FIG. 1E—all legs are fully engaged and body 6 is tightly stretched.

As seen in FIGS. 2–8 the hamper has a generally rectangular shape with rounded corners and one leg 5 at each corner. The body part 6 is essentially a tube of flexible sheet material extending between the top and bottom frames 3–4 and secured to these frames by staples 11. In the collapsed state of FIG. 2 body 6 is folded inwardly to lie in space between the frames. Lid 1 is pivotally connected by hinges 9 to top frame 4.

When this hamper 10 is in its assembled state the top and bottom frames are parallel and spaced apart by four legs 5 at the four corners, the legs positioned transversely or more specifically perpendicular to the planes of the top and bottom frames. Each leg has a top part 5T permanently secured to one corner of the top frame by an elastic coupling means which will be discussed in more detail below. The bottom end 5B of each leg 5 engages a recess 8 in one corner of bottom frame 3 when the hamper is in its assembled state.

In this assembled state of the hamper the length of each leg 5 is dimensioned to be slightly greater than the length of body 6, so that when the leg is pivoted into its perpendicular orientation it causes the top and bottom frame to be separated by the length of the leg which stretches the body while the leg itself is placed in compression. The combination of frames with legs in compression while the body is in tension creates a tight, substantially stable structure. In the assembled state body 6 forms generally straight and tight walls which define an enclosure for containing clothing or other articles placed therein.

As seen in FIGS. 1D, 4, 7 and 8 the bottom part 5B of each leg becomes releasably secured in a recess 8 in the bottom frame 3. Two forms of recesses are illustrated herein. The first form shown in FIGS 1A–1E and FIGS. 8B and 8C is a notch 8 formed in the top surface of the bottom frame at each of the peripheral corners. Each notch has an inner wall or shoulder 8X formed in the bottom frame and an outer wall 8Y formed by body 6 situated adjacent the corner.

The second form of notch shown in FIGS. 8A, 8D, and FIGS. 4, 7 and 8 is a recess in the corner in the surface of the top frame where both inner and outer walls 8X, 8Y are formed by material of frame 3.

For disassembly the bottom portion 5B of each leg is releasable from a recess 8 and movable out of the recess by applying an upward pressure on leg 5 and on top frame 3 until the terminal edge 5T of the bottom end 5B of the leg is lifted out of recess 8.

Figure 3:
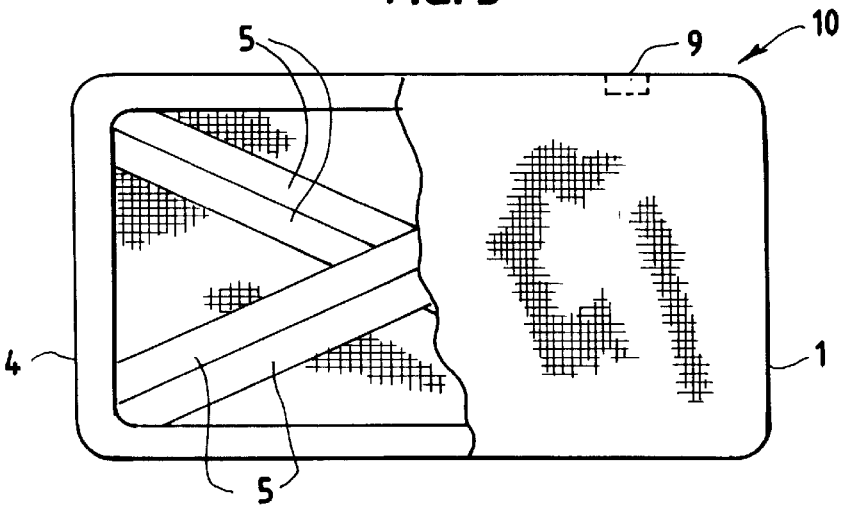
FIG. 3 is a partially cut-away top plan view of a fully collapsed hamper revealing partially the interior of the hamper and positioning of the folded leg assemblies.
Figure 7:
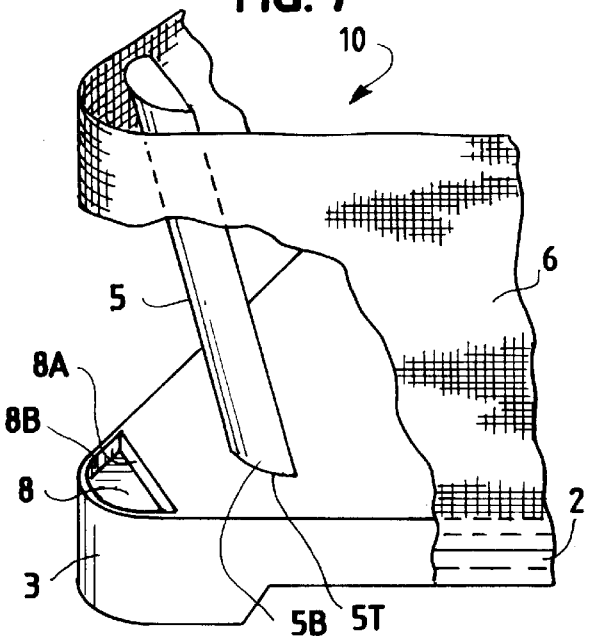
FIG. 7 is a fragmentary perspective view not to scale of the interior of the hamper showing a leg assembly prior to the insertion of its free end into a bottom frame recess.

After the bottom end 5B of the leg is released from recess 8, leg 5 is pivoted inwardly as seen in FIGS. 1C, 4 or 7, thus stretching elastic hinge means 7 at the top of the leg until the leg lies closely adjacent and parallel to the top frame. When all four legs are displaced and pivoted in this manner they lie as generally shown in FIG. 3 diagonally with respect to top frame 4.

Figure 2:
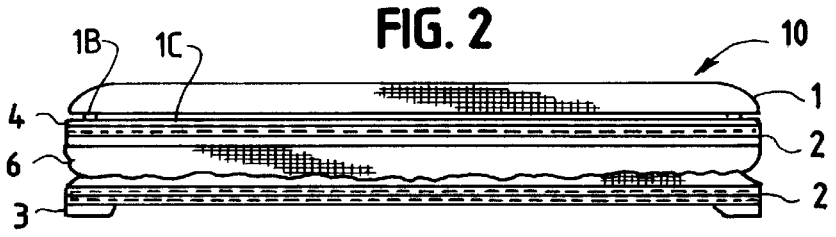
FIG. 2 is a front elevation of a fully collapsed hamper.

As the legs are fully folded the top frame 4 is moved downward toward the bottom frame 3, during which time the body 6 may be folded inwardly or randomly until the hamper is fully collapsed. FIG. 2 shows such collapsed hamper with the body 6 folded inward to lie between the frames.

The lid 1 of the hamper is pivotally attached to top frame 4. Spacer buttons 1B extend upward from the top surface of top frame 4 to allow an air space 1C between the lid and the top frame 4 for better ventilation.

The elastic hinge means 7 may be formed in a variety of ways, two preferred embodiments being described in detail below in the Section B. Leg Assemblies.

B. Leg Assemblies

Figure 10A:
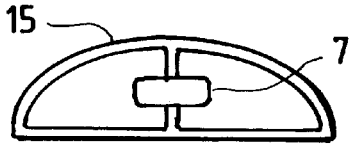
FIGS. 10A and 10B are top plan and front elevation views respectively of a two-piece leg assembly.
Figure 9B:
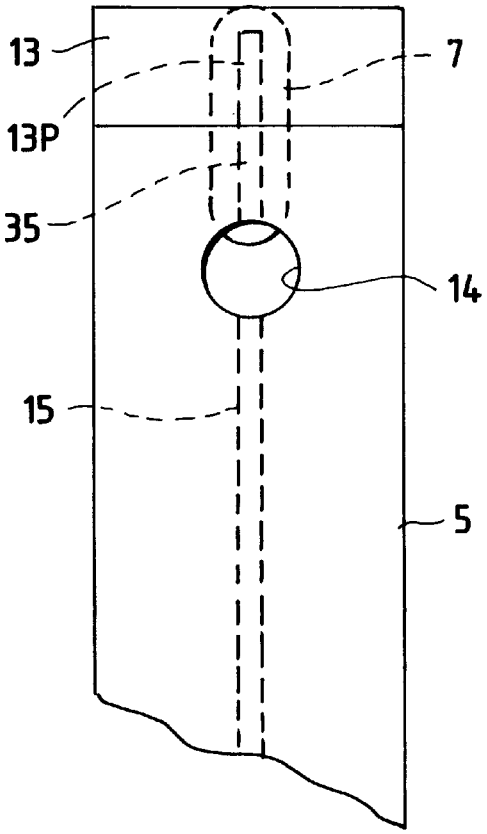
Figure 10B:
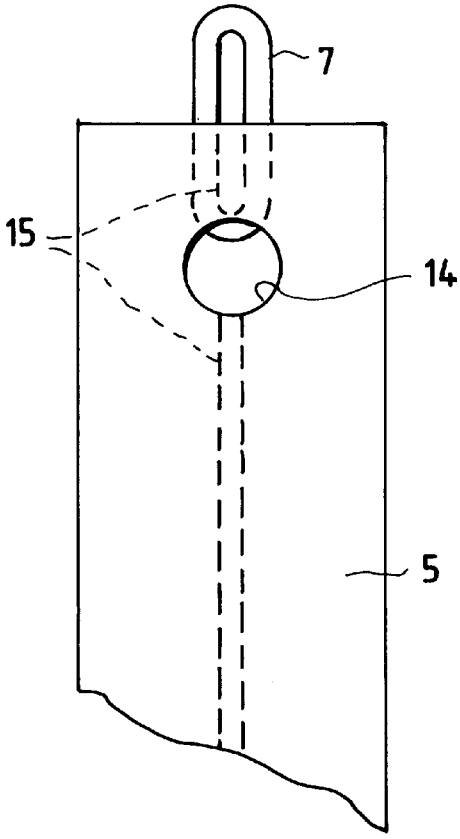
Figure 9C:
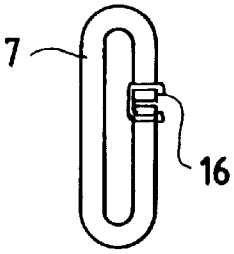
FIG. 9C is an elevation of the elastic loop.
Figure 10C:
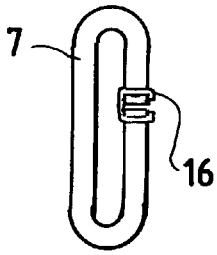
FIG. 10C is similar to FIG. 9C showing an elastic loop.
Figure 11:
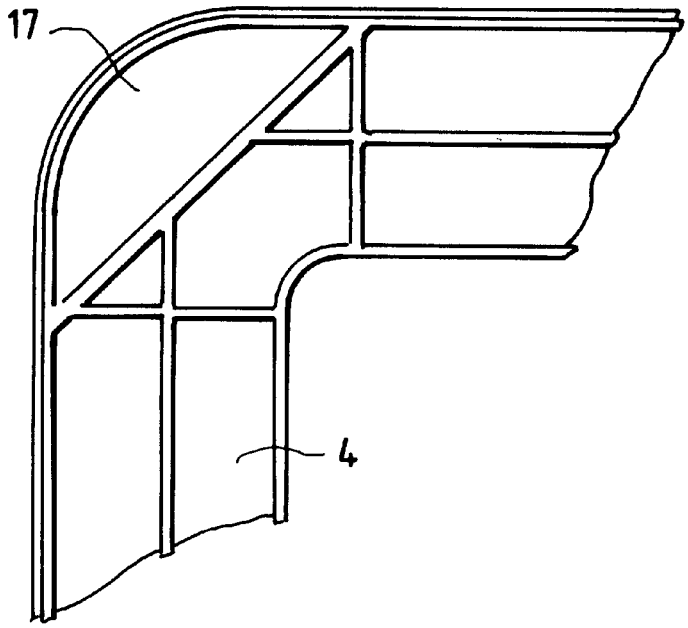
FIG. 11 is a fragmentary bottom plan view of a top frame for a three-piece leg assembly.
Figure 12:
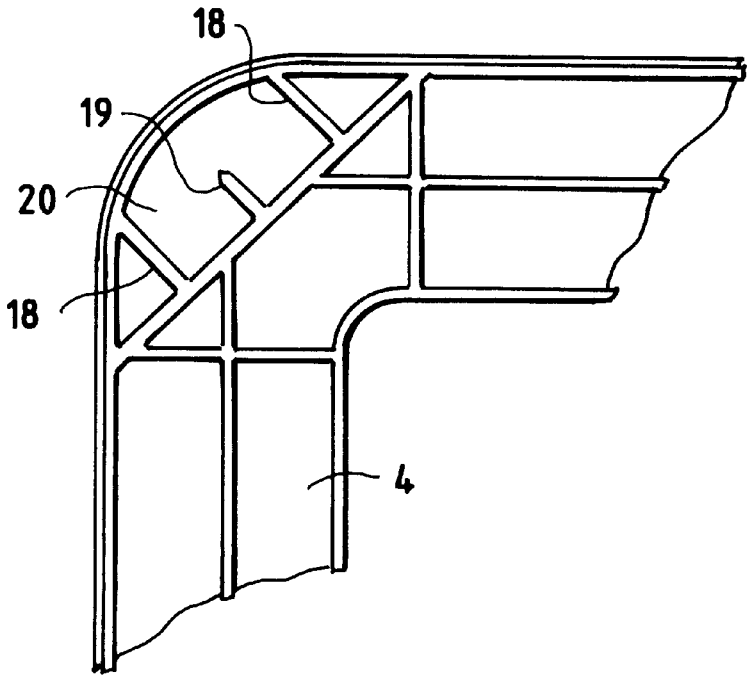
FIG. 12 is a fragmentary bottom plan view of a top frame for a two-piece leg assembly.

Two alternate leg assemblies are shown, namely a three-piece leg assembly of FIGS. 9, 11, 5, 6, 13, 14, and 15 and a two-piece leg assembly of FIGS. 10 and 12. In both embodiments the top of leg 5 is secured to the top frame by an elastic hinge means 7 which allows leg 5 to be pivoted to lie generally parallel to the frame.

The three piece leg assembly utilizes a basic long leg 5 about 19 inches in length, a short leg 13 of similar cross-section and about ⅝ inches in length, and an elastic strap securing the two legs together. The legs are made of any generally rigid material such as wood, metal or extruded or molded plastic.

The short leg is fixed within the upper frame 4 and with the upper frame defines a recess 4R of small depth for receiving the top end 5T of the long leg. The engagement of the long leg in this recess 4R provides lateral stability to the top end of leg 5 and stiffness to the joint depending on the depth of the recess and the closeness of fit. With such recess 4R leg 5 must be displaced slightly downward before being pivoted. If the short leg is positioned to be flush with the bottom of the top frame the long leg will merely abut the short leg without entering a recess; the long leg in this case may pivot without initial downward displacement. In either case the elastic coupling 7 will be stretched and then urge the long leg to return toward its assembled position.

Figure 5:
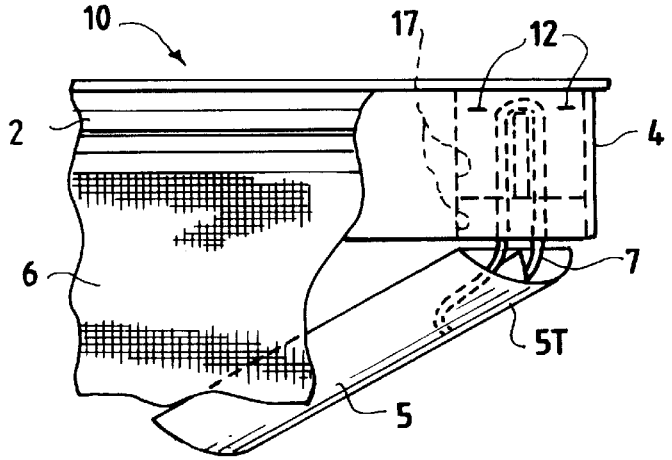
FIG. 5 is a fragmentary perspective view of a comer of the hamper showing the elastic mechanism for securing one end of a leg assembly to the frame.
Figure 6:
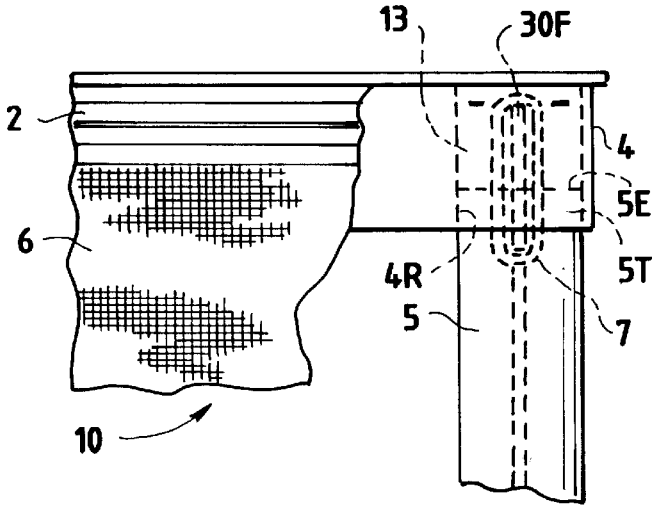
FIG. 6 is a fragmentary elevation view of a corner of the hamper of FIG. 3 partially revealing a leg assembly in its vertical position.

The structure illustrated in FIGS. 5 and 6 with the recess 4R for receiving the top end 5T of leg 5 provides a secure junction and also requires the user to displace the leg downward before pivoting. The additional stretching of elastic coupling 7 and assumes a significant return force urging the leg to return toward its assembled position.

When the leg is coupled to the frame in the hamper's assembled state the elastic coupling 7 should be at least snug to maintain the leg in place. When the leg is displaced downward from said frame the strap will be stretched and tend more strongly to urge the top of the leg back to the upper frame and back into the recess therein. Thus, when the hamper is in its collapsed state with the legs displaced and pivoted and assembly is begun, each leg will automatically be urged and directed by the strap to its proper position to be engaged in or with the upper frame.

Figure 8:
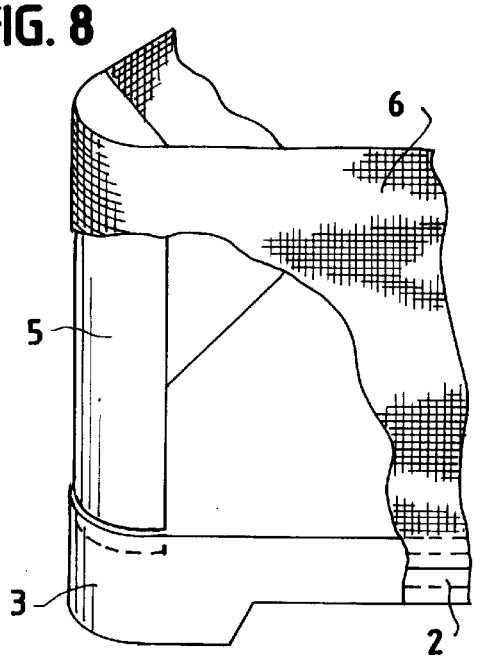
FIG. 8 not to scale is similar to FIG. 7 showing the leg assembly after it has been fully engaged into a bottom frame recess.
Figure 8B:
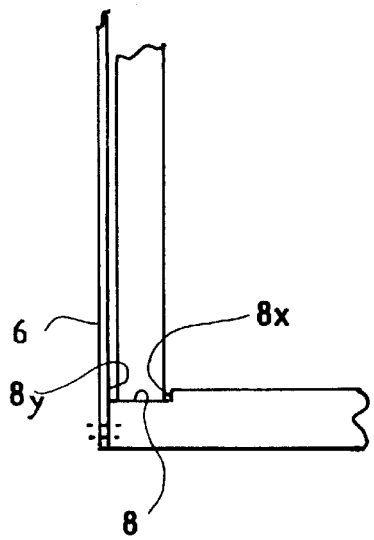
FIG. 8B is a fragmentary elevation view showing second embodiment of a lower frame recess.
Figure 8A:
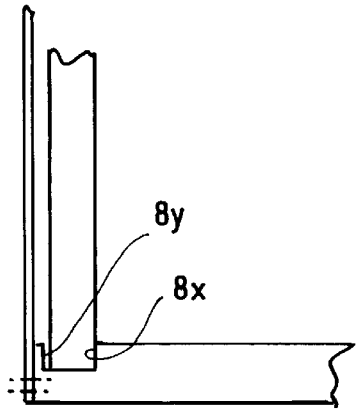
FIG. 8A is a fragmentary elevation view showing a first embodiment of a lower frame recess.
Figure 8C:
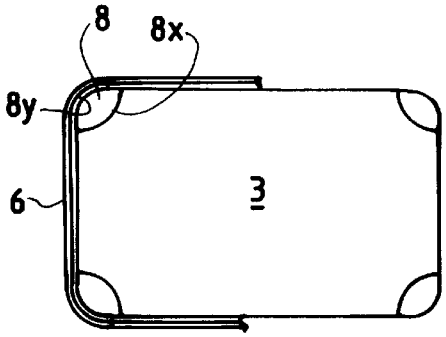
FIG. 8C is a schematic top plan view of one embodiment of the bottom frame.
Figure 8D:
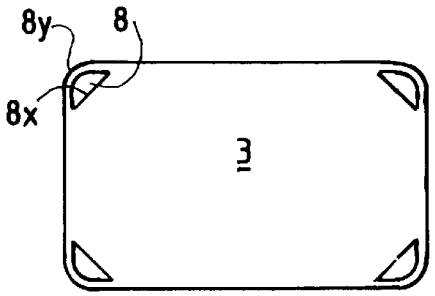
FIG. 8D is a schematic top plan view of a second embodiment of the bottom frame.
Figure 9A:
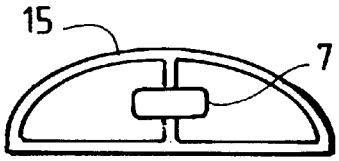
FIGS. 9A and 9B are top plan and front elevation views respectively of a three piece leg assembly.

A still further benefit which the new structure as indicated in FIG. 8C, assuming a user to be assembling this hamper in upright orientation, as top frame 4 is lifted upward in the direction of arrow I away from bottom frame 2 and the legs 5 approach their proper position and orientation, the bottoms 5B of these legs engage and drag across the top surface of bottom frame 2 while body 6 resists being stretched in the direction of arrow I. Friction is established between the bottom ends 5B and frame 2 sufficient to keep these legs from re-collapsing. Thus, the hamper is essentially self-supporting in a partially assembled state and will not fall down as the user attempts to force each leg to its final position. This is a significant advantage over prior collapsible hampers for which assembly is often a difficult and frustrating exercise.

The design of the legs 5 and 13 is such that they comprise an outside wall which is semielliptical in shape, measuring approximately ½" high and 1⅝" inch wide, and an outside straight wall approximately 1⅝" long. The two ends of the semi-elliptical wall are connected by the edges to the edges of the outside straight wall. An internal center wall or rib 15 divides the interior space of the legs created by the arrangement of the straight walls and the elliptical walls. This center wall 15 is perpendicular to the outside straight wall and spans the interior space between the center line of the outside straight wall and the center line of the outside semi-elliptical wall vertically along the interior length of the legs. In this fashion the interior space of the legs is divided into two sections of equal volume running the entire vertical length of the legs.

For joining the long and short legs 5, 13 together the elastic coupling is a bungee cord formed into a closed loop where the loop has top and bottom portions which encompass transverse projections in the long and short legs respectively or are otherwise secured to these legs. FIG. 13 shows that a portion of the central rib 15 in leg 5 is cut away by access hole 14, leaving projection 35 to engage the bottom of elastic loop 7. In the short leg 13 there is a portion 13C of the central rib which serves as the transverse projection to engage the top part of elastic loop 7. FIG. 13 illustrates this loop in its stretched state, since it would be in tension even when the two legs were in abutment.

The short leg 13 is secured in recess 4R of top frame 4 by any practical means, including adhesive or by staples 11 as seen in FIG. 15 where the staples are merely inserted through the walls of the frame and leg 13.

To form the transverse projection 35 in the long leg 5, access hole 14 is either molded or drilled into the leg. This hole is approximately ½" in diameter and is approximately ¾" from the top of the long leg 5, extends only through the flat side of the long leg 5 and is centered horizontally in the long leg 5. This hole is deep enough to remove most of the center wall 15 of the long leg.

The elastic material 7 is 5/32" diameter bungee cord cut to approximately 3" in length that may be purchased as Part No. SPFX-4, Multicolor Fibertex from Bungee International Mfg. Corp. in Chatsworth, Cal. The two ends of the elastic material 7 are placed into the access hole 14 and separated by the center wall 15 in the long leg 5. The two ends of the elastic material 7 are then directed toward the end of the long leg 5 closest to the access hole 14 and pushed until both ends extend out of the end of the long leg 5. This elastic is sufficiently strong to pull the long leg upward into engagement with the top frame when this leg is displaced or pivoted from the top frame and to pull the long leg toward the top frame at all times.

The short leg 13 is matched in shape to the end of the long leg 5, and the two ends of the elastic material 7 are placed up through the short leg 13 making certain that they are separated by the center wall 15 of the short leg 13. The two ends of elastic material 7 are pulled completely through the short leg 13, overlapped approximately ¼", and then crimped to form a loop of elastic around the center wall 15 of the long and short legs 5 and 13. A hog ring 16 obtainable from Stanley Bostitch Company may be used to crimp the elastic material 7 together for this purpose. The short leg 13 and the long leg 5 are now fastened together end-to-end under tension of the elastic material 7, and the leg assembly is ready for insertion into the leg assembly cavity 17 seen in FIGS. 6, 11 and 15.

The alternate two-piece leg assembly shown in FIGS. 10 and 12 has the elastic secured to the top of the leg in the same manner as disclosed for the three-piece assembly, and the top end of the elastic is attached directly to the upper frame in the receiving cavity thereof. FIG. 12 shows the top frame cavity 20 to accept the two piece leg assembly where there is provided a hook 19 as the transverse projection for receiving the top of the elastic loop, and stops 18 providing shoulders against which the top terminal end 5E of the leg abuts. The stops establish the proper upward distance into the top frame into which the end of the leg is inserted. In the three piece assembly there is no need for stops 18 of FIG. 12, because the short leg which is preliminary secured in the recess provides an abutment against which the long leg can engage. These legs can be made from any rigid material such as wood or extruded or molded plastic.

C. Top and Bottom Frames

The top and bottom frames have the same circumference which also corresponds to that of the tubular body sheet encompassing the frames being used.

Where the three-piece leg assembly is used the short leg 13 of the leg assembly is situated in the top frame leg assembly cavity 17 such as to define an upward extending recess of about ⅜ inch deep for receiving the top end 5E of a leg assembly. As a long leg is pivoted into position perpendicular to the top frame 4 it is pulled up the approximately ⅜" into cavity 4R by action of an elastic material 7. The long leg end therefore is brought up against the end of the short leg 13 and secured from transverse displacement by the side walls of the recess.

If a two-piece leg assembly is used, the leg assembly cavity 20 seen in FIG. 12 has two stops 18 that effectively shorten the depth of the leg assembly cavity 20 to ⅜" deep. As the long leg 5 of the leg assembly is moved into a position perpendicular to the top frame 4 it is pulled up into the leg assembly cavity 20 ⅜" until it reaches the leg assembly cavity stops 18 by action of the elastic material 7.

The bottom frame 3 has recesses to capture bottom ends of the leg assemblies. The bottom frame has the same shape as top frame 4 and contains leg recesses 8 equal to the number of leg assemblies being used. The leg recesses 8 completely surround the ends and part of all of the sides of the leg assemblies. The leg recesses 8 can be formed by the bottom frame 3 itself or by a combination of the bottom frame 3 and the body material 6. The leg recesses 8 have the function of holding the free ends of the leg assemblies in place after the hamper has been assembled. As long leg 5 ends opposite the hinged ends of the leg assemblies are moved into perpendicular positions relative to the top frame 4, the free leg ends of the long legs 5 approach the leg recesses 8 which are approximately 3/32 deep. The leg recesses 8 are formed by a 45 degree cut across the corners of the bottom. The body material 6 is positioned approximately ½" inch from the center of the outside radius of the leg recess. As the free leg ends of the long legs 5 slide over the bottom frame they drop over the 45 degree wall of the leg recesses 8 and are captured by the radius created by the flexible, compressible and foldable body material 6 and the 45 degree walls of the leg recesses 8. The bottom frame 3 has a vertical surface around its circumference sufficiently wide to allow attachment of the body material 6. The bottom frame 3 may be constructed out of any rigid material such as a wood product or a plastic. The bottom frame 3 may have slots or other apertures in its horizontal surface to allow increased ventilation within the assembled hamper.

D. Body of Flexible Sheet Material

Body 6 is made of flexible sheet material which may be woven or non-woven, synthetic or natural, or any combination of the above. Body 6 is cut into a rectangular shape with the short ends fastened to each other through sewing or heat sealing to create a tube. The tube's circumference is slightly smaller than the outside circumferences of the bottom frame 3 and top frame 4. The height of the tube is determined by the length of the leg assemblies 5. To determine the necessary height of the tube the leg assemblies are erected into position between the top frame 4 and bottom frame 3, and the distance between the bottom horizontal edge of the bottom frame 3 and the top horizontal edge of the top frame 4 is the height of the tube.

E. Trim

Trim 2 is made from a woven or non-woven, synthetic or natural material or a material utilizing any of the above in any combination. The trim 2 has two functions, namely to cover staples 11 that attach the body 6 to the bottom frame 3 and top frame 4, and to help secure the body 6 to the bottom frame 3 and top frame 4.

F. Manufacturing

Manufacturing begins by attaching the leg assemblies 5 to the top frame 4. The style of leg assembly 5 used, namely the three-piece or two-piece assembly, determines the operation to be performed. If a three piece leg assembly is used the short leg 13 is first completely inserted into the leg assembly cavity 17 and then secured within the leg assembly cavity 17 (see FIG. 11) by means of staples extending through the top frame and the short leg 12 and/or glue. If a two piece leg assembly is used, the end of the long leg from which a loop of elastic material 7 protrudes is placed next to the leg assembly cavity 20 (see FIG. 12) and the loop of elastic material 7 is hooked or fastened into the leg assembly cavity. In a preferred embodiment the loop of elastic material 7 is stretched over a hook 19 built into the leg assembly cavity 20 as seen in FIG. 11. These operations are repeated according to the number of leg assemblies used.

After the leg assemblies have been attached into the top frame 4 the top frame 4 is placed into a fixture allowing the unattached ends of the leg assemblies 5 to stand vertically upright. The body material 6 is then placed over the leg assemblies 5 and pulled down over the outer circumference of the top frame 4. Any seam in the body 6 is placed at the back side of the hamper body. The body 6 is attached to the top frame 4 by means of staples placed through the body 6 into the top frame 4 at distances of ¾" apart and ¼" from the bottom edge of the body. The staples used can be obtained from BEA, are style #72, and are approximately ⅜" long.

For final construction the top frame is placed on a fixture which has been designed to position the bottom frame 3 an appropriate distance from the top frame 4 while centering the outer circumferences of the bottom frame 3 and top frame 4. When the bottom frame 3 has been positioned the body 6 is pulled to overlie frame 3 and be evenly tensioned between the frames while staples are used to fasten the body material 6 to the bottom frame 3. The stapling to be done on the bottom frame 3 corresponds to that used for the top frame 4.

Trim is now be placed upon the hamper. Depending on the style of the trim 2 used, it can be attached to the bottom frame 3 and top frame 4 using staples either BEA #97 ⅜" long or BEA #72 ⅜" long. The trim 2 is seamed at the back of the hamper body and is installed as two separate pieces, one piece for each of the bottom frame 3 and top frame 4. The trim 2 is positioned over the staples used to fasten the body 6 to the bottom frame 3 and top frame 4.

After attachment of the trim 2 the hamper is removed from the fixture and the free ends of the leg assemblies 5 are pushed into their respective leg recesses 8. The body 6 is checked for sufficient tension. The lid 1 can be produced from different materials including particleboard purchased from a vendor such as Georgia-Pacific Corp.; it can be covered with a woven or non-woven, synthetic or natural material and optionally with padding included between the rigid material and the covering. The lid 1 could also be simply an injection molded plastic component. The lid 1 is attached to the top frame 4 of the hamper using two metal stop hinges 9 which allow the lid 1 to open only slightly more than 90 degrees in relation to the top frame 4.

G. Use

A user receives a hamper packaged as described above, in the fully-collapsed position. With the bottom frame 3 of the hamper resting on the ground, the user grasps the top frame 4 and lid 1 of the hamper and pulls them up vertically, stretching the body 6. Holding the top frame 4 above the bottom frame 3 to the height of the body 6, the user grasps the free lower ends of the self-supporting leg assemblies 5, pushing them down into the leg recesses 8 located in the bottom frame 3 of the hamper. During this assembly and shortly before the legs are positioned vertically, the body 6 exerts great resistance to further stretching so that the final positioning of the legs may be quite difficult. Prior collapsible hampers have a tendency to fall down during this final phase of assembly; however, the present invention is essentially self-supporting before final assembly which is a great benefit and convenience to the user. When all leg assemblies 5 are in final placement the hamper remains upright and semi-rigid. The user may then place laundry or other items into the hamper for storage through opening the lid 1. To transport the hamper in its collapsed position the user simply repeats the steps outlined above in reverse order.

While several forms of the invention have been shown and described, other forms will now be apparent to those skilled in the art. Therefore, it will be understood that the embodiments shown in the drawings and described above are merely for illustrative purposes and are not intended to limit the scope of the invention which is defined by the claims which follow.

I claim:

1. In a collapsible hamper having top and bottom generally stiff frames, a body of flexible sheet material secured to and extending lengthwise between said frames for defining an enclosure, and a plurality of generally stiff legs each having top and bottom ends, said hamper having collapsed and assembled states, each leg positionable transversely between and engaging said top and bottom frames with its top and bottom ends respectively for urging said frames apart and thereby stretching said body in the lengthwise direction when said hamper is in its assembled state, said frames being moved toward each other and said body folded when said hamper is in said collapsed state, the improvement comprising elastic hinge means fixedly attaching the top end of each leg to said top frame, each of said legs being movable between a first position with said leg extending transversely from said top frame and the leg's bottom end releasably engaging said bottom frame when said hamper is in its assembled state, to a second position with said leg pivoted to be generally parallel and closely adjacent said top frame and the leg's bottom end separated from said bottom frame when said hamper is in its collapsed state, said hinge means, when said leg is pivoted, urging said leg to return to said first position.

2. Apparatus according to claim 1 wherein said leg when pivoted to said second position is also displaced downward from said top frame.

3. Apparatus according to claim 1 wherein said hinge means for each of said legs comprises an elastic band having top and bottom parts respectively secured to said top frame and to said top end of said leg.

4. Apparatus according to claim 3 wherein said hinge means comprises a closed loop, and said top frame and said top end of each leg each have projecting elements which engage said loop.

5. Apparatus according to claim 3 wherein each of said legs comprises a tube, and the bottom part of said elastic band extends into the top end of said tube and is secured thereto.

6. Apparatus according to claim 1 wherein said top and bottom frames have thickness T1 and T2 respectively in said lengthwise direction of said hamper, and said legs have thickness T3 in a direction transverse of their length, and said hamper in its collapsed state has total thickness no greater than T1+T2+2(T3).

7. Apparatus according to claim 1 wherein said top frame is generally rectangular with four comers, and each comer has a bottom part which defines therein and upward extending first recess of first cross-section, and the top part of each of said legs has a cross-sectional shape corresponding to that said first recess, said leg top part being removably insertable into said first recess.

8. Apparatus according to claim 7 wherein said first recess and said top part of said leg have cross-section that defines an enclosure formed by a straight line intersected by an elliptical curve.

9. Apparatus according to claim 1 wherein each of said legs comprises a long leg part for extending between said frames and a short leg part fixed to said top frame, said elastic hinge means being engaged to said long and short leg parts.

10. Apparatus according to claim 7 wherein each of said legs comprises a long leg part for extending between said frames and a short leg part fixed to said top frame, said elastic hinge means being engaged to said long and short leg parts.

11. Apparatus according to claim 10 wherein said hinge means comprises an elastic band.

12. Apparatus according to claim 11 wherein said hinge means is formed as a closed loop.

13. Apparatus according to claim 10 wherein said first recess has depth $D_1$, in the lengthwise direction of said hamper, and said short leg part has length $D_2<D_1$, said short leg part being inserted into said first recess a distance greater than $D_2$, thereby defining a second recess for receiving the top end of the long leg when inserted therein.

14. Apparatus according to claim 1 wherein said hinge means urges said top end of the leg toward said top frame whenever said top end is displaced from its first position.

15. Apparatus according to claim 1 further comprising a lid engaged to said top frame and pivotal between a closed position where it lies generally parallel and closely adjacent said top frame and an open position.

16. Apparatus according to claim 2 wherein the top end of said leg in its second position is separated from said top frame.

17. Apparatus according to claim 1 wherein said hamper further comprises means for releasably engaging each of the leg's bottom ends to said bottom frame.

18. Apparatus according to claim 17 wherein said bottom frame defines downward extending recesses, each for receiving and holding the bottom end of one of said legs in its first position.

19. A collapsible hamper having collapsed and assembled states, said hamper comprising top and bottom generally stiff frames, a body of flexible sheet material secured to and extending lengthwise between said frames for defining an enclosure, a plurality of generally stiff legs each having top and bottom ends, each leg positionable transversely between and engaging said top and bottom frames with its top and bottom ends respectively for urging said frames apart and thereby stretching said body in the lengthwise direction when said hamper is in its assembled state, said frames being moved toward each other and said body folded when said hamper is in said collapsed state, and stretchable elastic hinge means fixedly attaching the top end of each leg to said top frame, each of said legs being movable between (i) a first position with said leg extending transversely from said top frame and the leg's bottom end releasably engaging said bottom frame when said hamper is in its assembled state, and (ii) a second position with said leg pivoted to be generally parallel and closely adjacent said top frame and the leg's bottom end separated from said bottom frame when said hamper is in its collapsed state, said hinge means, when said leg is pivoted, being stretched and urging said leg to return to said first position.

20. In a collapsible hamper having top and bottom generally stiff frames, a body of flexible sheet material secured to and extending lengthwise between said frames for defining an enclosure, and a plurality of generally stiff legs each having top and bottom ends, said hamper having collapsed and assembled states, each leg positionable transversely between and engaging said top and bottom frames with its top and bottom ends respectively for urging said frames apart and thereby stretching said body in the lengthwise direction when said hamper is in said assembled state, said frames being moved toward each other and said body folded when said hamper is in said collapsed state, the improvement comprising an elastic coupling attaching the top end of each leg to said top frame, each of said legs being movable between a first position with said leg extending transversely from said top frame and the leg's bottom end releasably engaging said bottom frame when said hamper is in said assembled state, to a second position with said leg pivoted to be generally parallel and closely adjacent said top frame and the leg's bottom end separated from said bottom frame when said hamper is in the collapsed state, such that said hamper is essentially self-supporting in a partially assembled state and will not fall down as each leg is located in a respective position for said assembled state.

21. In a collapsible hamper having top and bottom generally stiff frames, a body of flexible sheet material secured to and extending lengthwise between said frames for defining an enclosure, and a plurality of generally stiff legs each having top and bottom ends, said hamper having collapsed and assembled states, each leg positionable transversely between and engaging said top and bottom frames with its top and bottom ends respectively for urging said frames apart and thereby stretching said body in the lengthwise direction when said hamper is in said assembled state, said frames being moved toward each other and said body folded when said hamper is in said collapsed state, the improvement comprising an elastic material attaching the top end of each leg to said top frame, each of said legs being movable between a first position with said leg extending transversely from said top frame and the leg's bottom end releasably engaging said bottom frame when said hamper is in said assembled state, to a second position with said leg pivoted to be generally parallel and closely adjacent said top frame and the leg's bottom end separated from said bottom frame when said hamper is in the collapsed state, such that said hamper is essentially self-supporting in a partially assembled state and will not fall down as each leg is located in a respective position for said assembled state.

* * * * *

UNITED STATES PATENT AND TRADEMARK OFFICE

CERTIFICATE OF CORRECTION

PATENT NO : 6,089,394
DATED : July 18, 2000
INVENTOR(S) : Paul S. Ziglar

It is certified that error appears in the above-identified patent and that said Letters Patent are hereby corrected as shown below:

In Column 4, Line 27, delete the word "comer" and insert therefor --corner-- .

In Column 11, Claim 7, line 20, delete the word "comers" and insert therefor --corners-- .

In Column 11, Claim 7, line 20, delete the word "comer" and insert therefor --corner-- .

Signed and Sealed this

Seventeenth Day of April, 2001

*Attest:*

Nicholas P. Godici

NICHOLAS P. GODICI

*Attesting Officer*

*Acting Director of the United States Patent and Trademark Office*